US009237610B2

(12) United States Patent
Neser et al.

(10) Patent No.: US 9,237,610 B2
(45) Date of Patent: Jan. 12, 2016

(54) LED LAMP WITH DUTY CYCLE DIMMING

(75) Inventors: Morne Neser, Montreal (CA); Truong-Khoa Nguyen, St-Laurent (CA); Christian Poirer, Quebec (CA); Louis Bacon, Quebec (CA)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 187 days.

(21) Appl. No.: 13/588,258

(22) Filed: Aug. 17, 2012

(65) Prior Publication Data

US 2014/0049185 A1 Feb. 20, 2014

(51) Int. Cl.
*H05B 37/02* (2006.01)
*H05B 33/08* (2006.01)

(52) U.S. Cl.
CPC ..... *H05B 33/0803* (2013.01)

(58) Field of Classification Search
CPC .. H05B 37/029; H05B 41/28; H05B 33/0815; H05B 33/0818
USPC ..... 315/201, 209 R, 307, 291, 250
See application file for complete search history.

(56) References Cited

U.S. PATENT DOCUMENTS

| | | | | |
|---|---|---|---|---|
| 8,569,976 | B2 * | 10/2013 | Shteynberg et al. | 315/307 |
| 2007/0057641 | A1 * | 3/2007 | Russell et al. | 315/209 R |
| 2009/0079359 | A1 * | 3/2009 | Shteynberg et al. | 315/291 |
| 2012/0032604 | A1 * | 2/2012 | Hontele | 315/201 |
| 2012/0286696 | A1 * | 11/2012 | Ghanem | 315/291 |
| 2013/0134903 | A1 * | 5/2013 | Neser et al. | 315/297 |

* cited by examiner

*Primary Examiner* — Douglas W Owens
*Assistant Examiner* — Syed M Kaiser
(74) *Attorney, Agent, or Firm* — GE Global Patent Operation; Peter T. DiMauro

(57) ABSTRACT

A dimmable LED lamp assembly includes a power supply configured to receive an input power signal and produce a DC lamp current, a LED lamp coupled to the DC lamp current and configured to produce an amount of light corresponding to an amount of the DC lamp current, and a dimming controller coupled to the power supply and configured to adjust the amount of DC lamp current. The dimming controller is coupled to the input power signal and is further configured to determine a required dimming level based on the input power signal and to adjust the amount of DC lamp current such that the amount of light produced by the LED lamp corresponds to the determined required dimming level.

17 Claims, 5 Drawing Sheets

LED LAMP WITH DUTY CYCLE DIMMING

BACKGROUND

1. Field

The aspects of the present disclosure relate generally to traffic signals and in particular to dimming of LED traffic signal lamps.

2. Description of Related Art

In recent years, there has been a great deal of effort directed towards developing lighting systems that use less electrical power. A significant amount of energy is wasted by present commercial traffic control lighting systems when operated at a single level of power. The high light output typically required for visibility during daylight operation greatly exceeds that which is required for visibility during the night-time hours and can also create excessive amounts of glare for drivers approaching the signal light at night leading to unsafe driving conditions. To overcome these problems, street traffic controllers have been developed that are capable of controlling the light level of signal lights such that full brightness is used during daylight hours, and a dimmed, more energy efficient and less glaring light level is used during nighttime.

Early street traffic controllers were designed for use with incandescent signal lamps that were typically operated directly off the local mains power, such as the 110 volt, 60 Hertz grid power available in North America. A common approach used to dim incandescent signal lamps is to use a form of pulse width modulation known as phase control dimming to adjust the amount of power delivered to the incandescent signal lamp. In phase control dimming a gated diode like device, such as a silicon controlled rectifier (SCR), thyristor, or triode for alternating current (TRIAC), is used to shut off the current each time the mains voltage, which is used to supply power to the lamp, changes direction. The current is then turned back on a variable amount of time (phase angle) after the start of each alternating current half cycle, thereby controlling the amount of power delivered to the lamp. Various forms of phase control dimming are used in traffic controllers that all have the characteristic of turning the lamp power signal off for a portion of each half cycle of the input power. Common forms of phase control dimming are referred to as forward phase control dimming and reverse phase control dimming.

FIG. 1 illustrates graphs 101, 102 of lamp power signals produced by forward phase control dimming. Each graph shows voltage along the vertical axis and time along the horizontal axis. In forward phase control dimming, the lamp power signal is turned on part way through each half cycle of the input power. By controlling the point or phase angle at which the lamp power signal is turned on, the amount of power contained in the lamp power signal may be varied. Graph 101 illustrates a lamp power signal produced by a load switch comprising a TRIAC device configured to provide forward phase control dimming. In certain load switches the input power is rectified along with phase control resulting in a DC forward phase control dimming signal as shown in graph 102. Such a lamp power signal 102 may be produced by a load switch comprising a rectifier and a SCR device. Alternatively, reverse phase control dimming may be used in a traffic signal load switch.

Reverse phase control dimming is where the lamp power signal is turned off for an amount of time before the end of each half cycle as illustrated by graph 201 shown in FIG. 2. Each graph in FIG. 2 shows voltage along the vertical axis and time along the horizontal axis. Reverse phase control dimming may also be applied along with rectification resulting in a reverse phase control dimming signal as illustrated in graph 202. With any of these phase control signals 101, 102, 201, 202, the resulting lamp power signal may be viewed as a pulse width modulated signal where the duty cycle is related to the signal's power content. For the purposes of this disclosure, the duty cycle of a phase clipped AC signal, such as those shown in graphs 101, 102, 201, and 202, is defined as the ratio of on-time, i.e. the amount of time where the voltage is non-zero, to off-time, i.e. the amount of time where the voltage is substantially zero, and phase clipped signals such as those illustrated in FIGS. 1 and 2 are referred to as phase control dimming signals.

Replacing incandescent signal lamps with Light Emitting Diode (LED) light sources has become a commonly used approach for reducing energy consumption. It has been long known that LED lights or LED lamps can provide significant reductions in the amount of electricity consumed by traffic signaling applications and also provide better reliability, lower heat generation, improved vibration resistance, and longer lifetimes of the traffic signaling. LED replacement lamps typically comprise an array of individual LED elements arranged in a circular pattern such that the unit is the same size as a standard incandescent traffic signal lamp. By using arrays with a large number of individual elements, failure of several individual elements can be tolerated before the lamp unit needs to be replaced leading to longer overall lamp lifetime. This gradual failure mode also avoids the unsafe condition resulting from failure of an incandescent lamp, such as when the red stop lamp burns out.

It is expensive, and can take extended periods of time, to replace an entire signaling system, including controller, wiring, and light fixtures, with signaling systems designed for use with LED lamps. An attractive alternative to replacing the entire system is to create LED replacement signal lamps that are both physically and electrically compatible with current incandescent signal lamp standards, allowing the more efficient and reliable LED replacement lamps to be retrofit directly into older systems without making any other changes to the older systems. This also allows for a gradual upgrade of older systems by installing an LED replacement lamp each time an older incandescent lamp burns out. The LED light elements used in these replacement signal lamps require low level DC power, often around 12 volts DC. Small switching power supplies are typically included in LED replacement signal lamp assemblies to convert the AC mains voltage supplied by existing traffic control systems into the low level DC voltage required by LED light elements. Unfortunately, the switching power supplies used in LED replacement lamps regulate the lamp power internally and need only a small amount of input power. Consequently LED lamps that include switching supplies produce the same light level even when the input power is reduced by phase control dimming. LED light elements used in these replacement lamps have the capability of varying their brightness according to the amount of current applied, but due to the nature of the switching supplies used these capabilities are largely unused. Thus, the dimming capabilities of the existing street traffic controllers are nullified by the LED replacement lamps. Therefore, there exists a need for LED replacement signal lamps that provide dimming capabilities similar to incandescent lamps.

Accordingly, it would be desirable to provide a system that addresses at least some of the problems identified above.

SUMMARY

As described herein, the exemplary embodiments overcome one or more of the above or other disadvantages known in the art.

One aspect of the present disclosure relates to a dimmable LED lamp assembly. In one embodiment, the assembly includes a power supply configured to receive an input power signal and produce a DC lamp current, a LED lamp coupled to the DC lamp current and configured to produce an amount of light corresponding to an amount of the DC lamp current, and a dimming controller coupled to the power supply and configured to adjust the amount of DC lamp current. The dimming controller is coupled to the input power signal and is further configured to determine a required dimming level based on the input power signal and to adjust the amount of DC lamp current such that the amount of light produced by the LED lamp corresponds to the determined required dimming level.

Another aspect of the present disclosure relates to a method for controlling the brightness of an LED lamp. In one embodiment, the method includes sampling the voltage of an input power signal to create a digital input power signal, measuring a zero-level duration of the digital input power signal, generating a series of zero-level detection triggers from the digital input power signal, determining a period of the zero-level detection triggers, calculating a duty cycle of the digital input power signal based on the measured zero-level duration and the determined period of the zero-level detection triggers, and adjusting an amount of DC current delivered to the LED lamp such that a brightness of the LED lamp is in accordance with the determined duty cycle.

Another aspect of the present disclosure relates to a method of retrofitting traffic control signals that contain incandescent signal lamps with dimmable energy saving LED signal lamps. In one embodiment, the method includes providing a dimmable LED lamp assembly wherein the dimmable LED lamp assembly is configured to determine a required brightness based on an input power signal and adjust a brightness of the LED lamp assembly in accordance with the determined required brightness, packaging the dimmable LED lamp assembly such that it is physically and electrically compatible with the incandescent signal lamps, and replacing each incandescent signal lamp with the packaged dimmable LED lamp assembly.

DETAILED DESCRIPTION OF THE DISCLOSED EMBODIMENTS

Aspects of the disclosed embodiments are directed to an LED signal lamp unit that has electrical characteristics compatible with existing standards for incandescent signal lamps and provides dimmable operation when retrofit into existing traffic signaling systems that employ phase control dimming to control brightness of the lamp.

Figure 3:
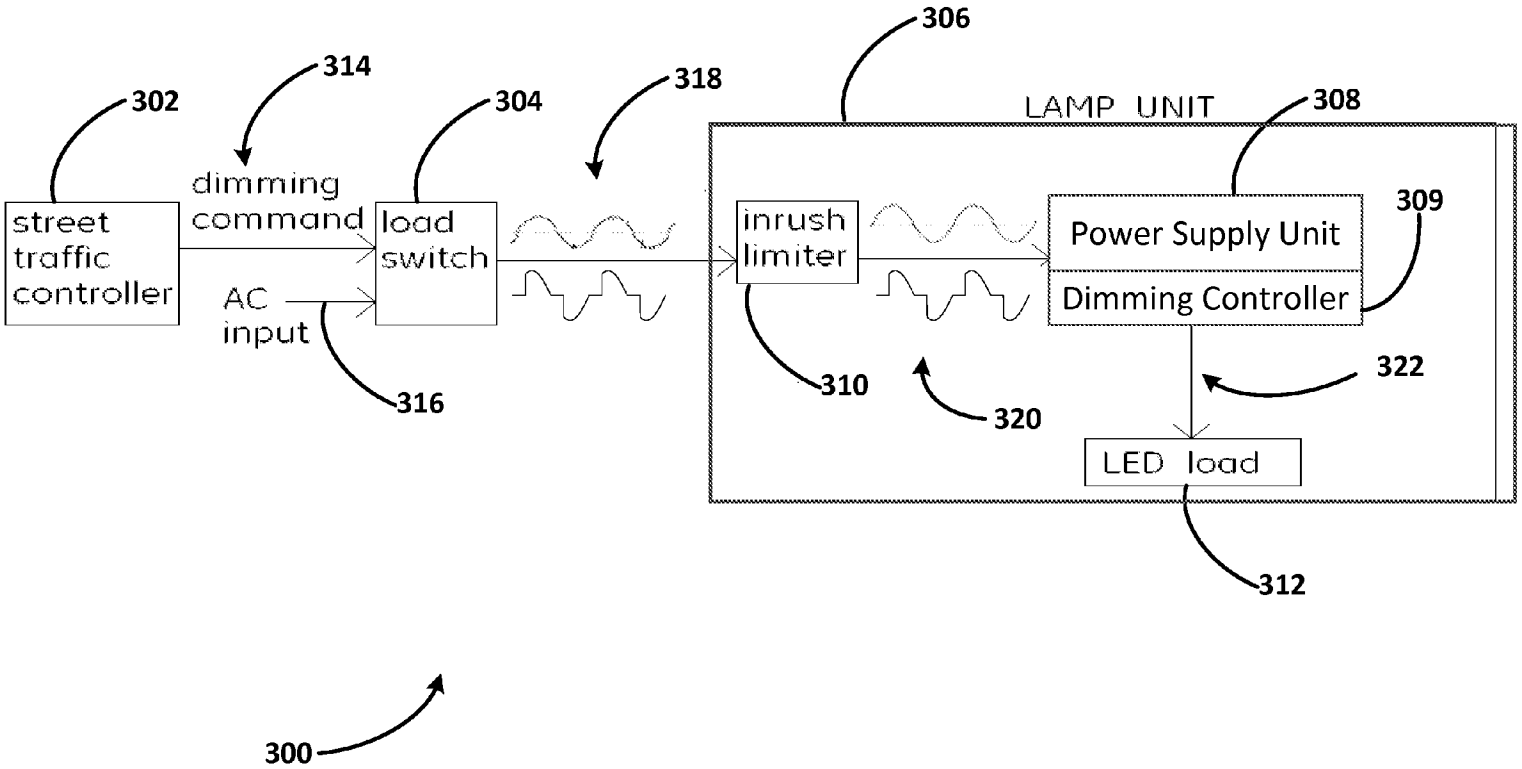
FIG. 3 illustrates a block diagram of a traffic lighting control system having an LED signal lamp incorporating aspects of the present disclosure.

Referring to FIG. 3, a block diagram of an exemplary traffic lighting or signaling system 300 in accordance with aspects of the disclosed embodiments is shown. The LED lamp unit 306, which includes an inrush limiter 310 and dimming controller 309, can detect when dimmed brightness is required and adjust the amount of light generated by the LED load 312 according to the amount of power in the input lamp power signal 318. Although aspects of the disclosed embodiments are generally described herein with respect to a traffic signaling lamps, the disclosed embodiments are not so limited and may be advantageously employed in other applications requiring dimming control of LED lamps as well.

The LED lamp unit assembly 306 of the disclosed embodiments generally includes an LED Load 312, a power supply unit 308, which in one embodiment includes a dimming controller 309, and an inrush limiter 310. The dimming controller 309 generally includes, is coupled to, or is in communication with, a microcontroller that includes a processor and is operable to detect when the input lamp power signal 318 supplied from the load switch 304 is a phase control dimmed power signal or a full-wave power signal and apply a corresponding dimmed or full brightness DC lamp current 322 to the LED load 312. In one embodiment, the dimming controller 309 is comprised of a microcontroller and machine-readable instructions that are executable by a processing device contained in the microcontroller. The microcontroller can comprise a small general purpose computer typically constructed on a single integrated circuit or small circuit board containing a processor, memory, and programmable input/output peripherals. In certain embodiments the microcontroller includes an analog-to-digital converter, digital-to-analog converter, and/or on board counters that can be used as frequency counters etc. Alternatively, the dimming controller 309 can include analog and/or digital circuits that are constructed to make the dimmed or full brightness determination and provide a corresponding signal to control the DC current supplied to the LED load 312 by the power conditioning components. Those skilled in the art will recognize that various combinations of microcontrollers, processing devices, analog circuits, and digital circuits can be used to construct the dimming controller 309 without straying from the spirit and scope of the present disclosure.

The LED load 312 is generally comprised of an array of individual LED light elements arranged in a circle similar in size to an incandescent signal lamp. The exemplary LED lamp unit assembly 306 conforms to the same electrical and physical standards required of incandescent signal lamps, and is thus physically as well as electrically compatible with typical traffic signaling systems, and therefore may be retrofit directly into a typical street traffic control system comprising a street traffic controller 302 and a load switch 304. The street traffic control system shown in FIG. 3 provides dimming control of lamp units by applying full-wave power when full brightness is desired and reduced power when a reduced brightness is desired. The exemplary LED lamp unit assembly 306 detects changes in applied power and adjusts the brightness of the LED load 312 accordingly.

As shown in FIG. 3, the exemplary traffic signaling system 300 comprises a typical street traffic controller 302 to provide a dimming command or control signal 314. The dimming control signal 314 may be continuously varied to operate the lamp at a brightness level between off and full brightness. The dimming control signal 314 is applied to a load switch 304 to control and generate the lamp power signal 318. The load switch 304 receives AC input power 316 and produces the lamp power signal 318 based in part on the dimming control signal 314. The AC input power 316 is typically supplied by the local mains power grid and may comprise the 120 volt, 60 Hertz power available in the United States, 50 Hertz 230 volt power available in many European countries, or other suitable AC power sources. When the dimming control signal 314 indicates an off state, the lamp power signal 318 generated by the load switch 304 is indicative of a no power state. When the dimming control signal 314 indicates that the lamp unit 306 should be turned on at a dimmed light level, the lamp power signal 318 generated by the load switch 304 is a reduced power level AC signal, such as the phase control dimming signals described in detail below. When the dimming control signal 314 indicates that the lamp unit 306 should be turned on at full brightness, the load switch 304 applies the AC input power 316 directly to the lamp unit 306 with no power reduction.

The lamp unit assembly 306 uses the lamp power signal 318 received from the signal load switch 304 to power both its internal components such as the power supply unit 308 and dimming controller 309, as well as the LED load 312. The dimming controller 309 monitors certain characteristics, such as the duty cycle of the lamp power signal 318 to determine a required lamp brightness level.

The lamp power signal 318 is received in the lamp unit 306 by an inrush limiter 310 that is designed to protect internal components of the lamp unit 306 from damage by controlling and limiting the amount of current flowing into the power supply 308. In many embodiments the power supply unit 308 includes energy storage components that draw large currents, referred to as inrush currents, when power is first applied to the lamp unit 306. Inrush currents may be of a magnitude that exceed safe operating limits of various components and thus may reduce the lifespan of a lamp unit 306. The inrush limiter 310 is configured to limit inrush currents and other current spikes that may be present in the input power signal 318. Limiting the current is accomplished by preventing the magnitude, or amount, of the current flowing into or out of the power supply, from exceeding a predetermined amount, thereby avoiding damage to the various components in the power supply unit 308. An amount or value of current as used herein refers to a quantity of electric current, such as a number of amperes of current. An additional benefit of the inrush limiter 310 is that it is also configured to filter out noise and higher harmonic distortions that may be contained in the lamp power signal 318. Cost is typically a consideration when designing a load switch such as the load switch 304 and typical load switches can often produce very noisy and distorted lamp power 318. The inrush limiter 310 filters the lamp power 318 thereby producing a substantially "clean" power signal 320, i.e. a signal that has relatively low noise and low harmonic distortion.

As shown in FIG. 3, the filtered power signal 320 from the inrush limiter 310 is received by the power supply unit 308 which in turn produces a lamp current 322 for lighting the LED load 312. In certain embodiments, the power supply unit 308 can comprise various power conditioning components such as for example a bridge rectifier, switching regulator, power factor controller, electromagnetic compliance filter, isolation transformer, output rectifier and/or output filter (not shown). A skilled artisan will recognize that any power supply unit 308 that is capable of converting the filtered power signal 320 into a DC lamp current 322 is within the spirit and scope of the disclosure. The power supply unit 308 is configured to vary the DC lamp current 322 continuously between no current and a full brightness current to produce corresponding LED load 312 brightness levels from no light to full brightness.

The dimming controller 309 may be included in the power supply unit 308 or alternatively may be a separate unit coupled to the power supply unit 308. In either configuration the dimming controller 309 is configured to control the power supply unit 308, such that the DC lamp current 322 is maintained at a level which will produce a desired brightness of the LED load 312. In one embodiment, the dimming controller 309 includes a microcontroller configured to analyze the filtered power signal 320 to determine the desired brightness level of the LED load 312. When the street traffic controller requires full brightness it sends a dimming control signal 314 to the load switch 304 that indicates full brightness, thereby causing the load switch 304 to produce a full lamp power signal 318 that is provided to the power supply unit 308 as a clean full power signal 320. When the street traffic controller 302 requires a dimmed LED light output, it produces a dimming control signal 314 that indicates a dimmed light output, resulting in a filtered power signal 320 having a reduced power level being provided to the power supply unit 308. The dimming controller 309 monitors the filtered power signal 320 to determine if full brightness or dimmed brightness is required and adjusts the power supply 308 to produce a lamp current 322 necessary to achieve the required brightness. As will be described in more detail below, the dimming controller 309 monitors the frequency of zero-level detection triggers 404 shown in FIG. 4 created from the filtered power signal 320 and measures the period and duration of zero-level occurrences in order to determine a required brightness level.

Figure 1:
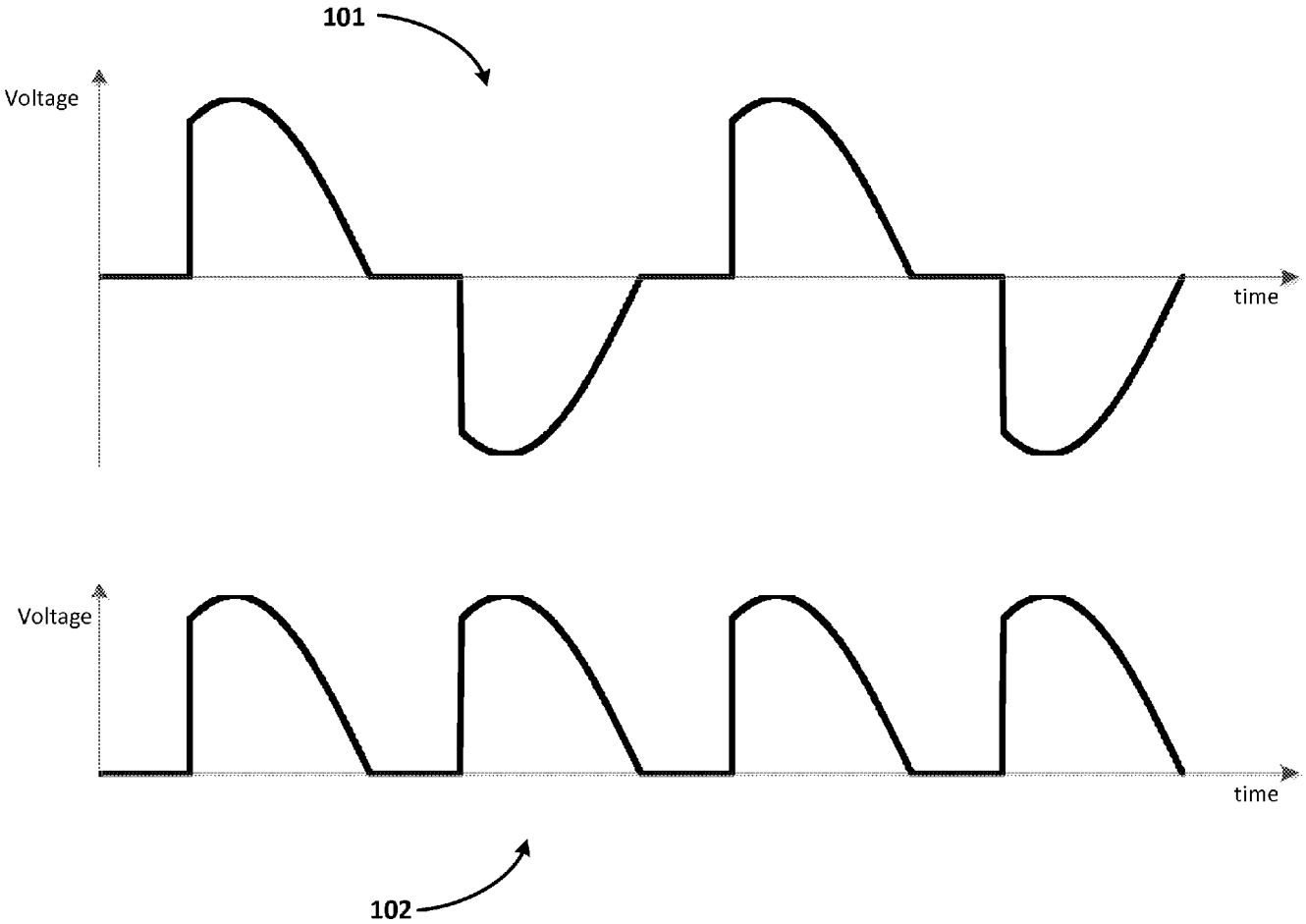
Figure 1 (Prior Art)
FIG. 1 illustrates graphs of lamp power produced by prior art traffic control systems using forward phase control dimming.
Figure 4:
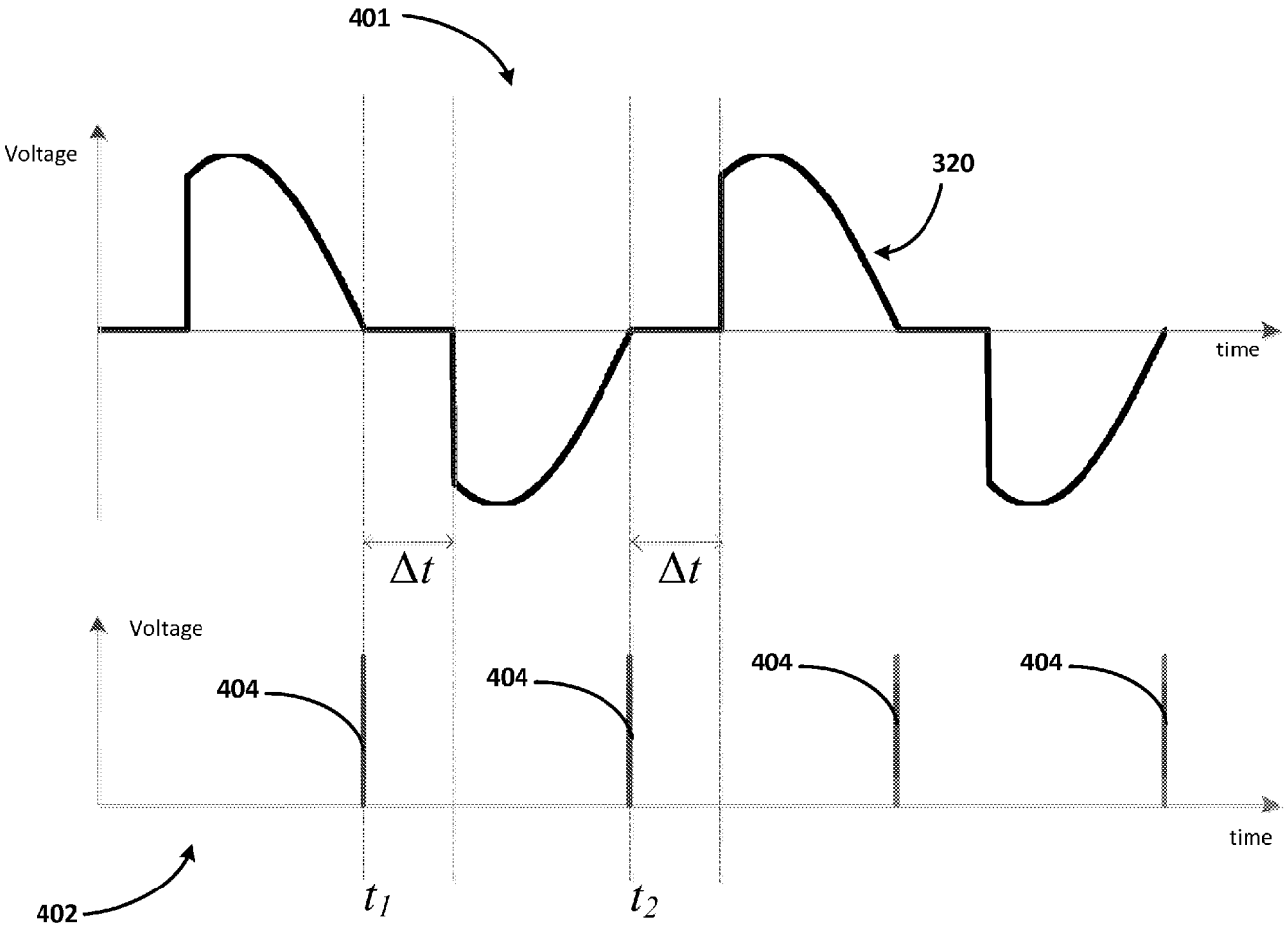
FIG. 4 illustrates graphs of signal analysis used by dimming controllers incorporating aspects of the present disclosure.

Referring to FIGS. 1 and 4, the filtered power signal 320 is received by the power supply unit 308 which generates a lamp current 322. The filtered power signal 320 is also used by the dimming controller 309 to determine the brightness level required by the traffic control system 300. The load switch 304 may be configured to produce a lamp power signal 318 that provides a desired level of lamp power using any of the phase control dimming approaches described above with reference to FIGS. 2 and 3. The filtered power signal 320 is between about 50 Hz to about 60 Hz (cycles per second) depending on the frequency of the AC input 316 which is typically connected to the local power grid. A series of zero-level detection triggers 404, which in one embodiment are in the form of signal pulses as illustrated in graph 402, is generated from the filtered power signal 320. A zero-level detection trigger 404 is generated each time the filtered power signal 320 goes to about zero volts as is the case at time $t_1$ and $t_2$. The zero-level detection triggers 404 are at a rate of about 100 Hz when 50 Hz grid power is supplied and at a rate of about 120 Hz when 60 Hz grid power is supplied. During forward phase control dimming, as illustrated in graph 401, the filtered power signal 320 includes periods of zero volts lasting for a time At after each zero-level detection trigger 404. An amount of time where the voltage is at or close to zero is referred to as a zero level duration. Comparing the length of each zero level duration At to the time between zero-level detection triggers 404, $t_2-t_1$, provides an indication of the brightness level required by the street traffic controller 302. Thus, the required brightness level may be related to the filtered power signal 320 using the duty cycle of the lamp power signal 318 which may be computed using the equation:

$$\left(1-\frac{\Delta t}{t2-t1}\right).$$

Figure 2:
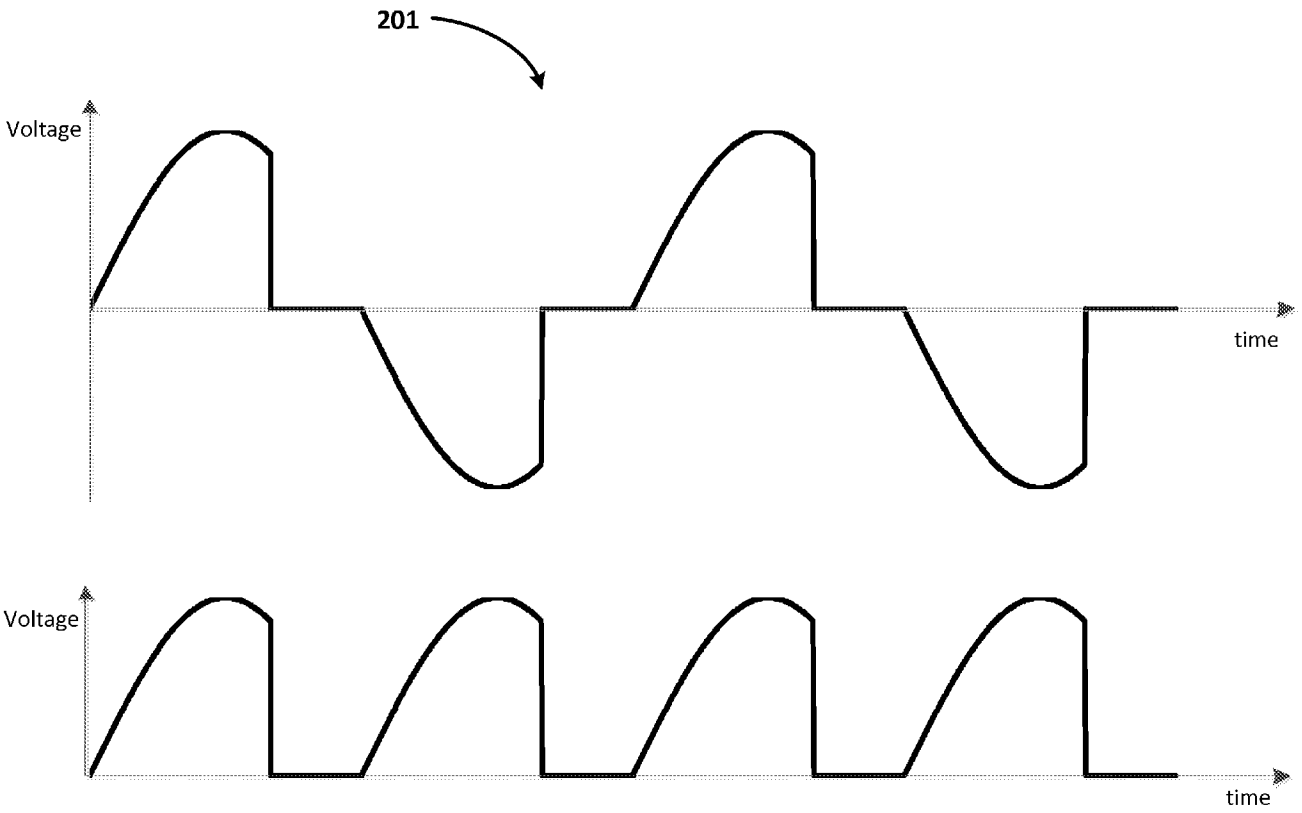
Figure 2 (Prior Art)
FIG. 2 illustrates graphs of lamp power produced by prior art traffic control systems using reverse phase control dimming.

Those skilled in the art will recognize that this relationship also holds for other forms of input power signals produced by other types of phase control dimming such as those shown in FIGS. 2 and 3 above as well as others. The above duty cycle determination also works equally well in systems that use dimming methods other than phase control dimming, such as for example half wave rectification.

In one embodiment, the power supply unit 308 includes a circuit (not shown) that generates zero-level detection trigger 404 each time the filtered power signal 320 goes to zero. These zero-level detection triggers 404 are input to a microcontroller included in the dimming controller 309, where a determination about the required dimming level is made. In certain embodiments a circuit, such as a counter circuit, is used to measure the period between zero-level detection triggers 404 and the period is provided to a microcontroller, or alternatively, the filtered power signal 320 can be provided directly to the microcontroller as a digitized power signal, such as for example by an analog-to-digital converter, and the microcontroller can be configured to locate the zero-level detection triggers 404 itself to help make the dimming level determination. The microcontroller is also configured to monitor the amount of time the filtered power signal 320 remains at or near zero volts, which is the zero-level duration Δt. The zero-level duration At may be obtained either by instructions executed in the microcontroller or by other circuits contained in the dimming controller 309 which provide the measured duration to the microcontroller. As will be described in more detail below, the power supply unit 308 uses the time between the zero-level detection triggers 404 and the zero-level duration At to make its determination regarding the required lamp brightness.

As described above with reference to FIGS. 3 and 4, when the traffic signal controller 302 requires full brightness it commands the load switch 304 to provide a full, i.e. not clipped, AC input power signal to the lamp unit 306, and when the controller 302 requires a dimmed brightness it commands the load switch 304 to provide a lamp power signal 318 with a duty cycle that will produce the required brightness. The exemplary lamp unit 306 monitors the lamp power signal 318 and sets the lamp brightness accordingly.

Figure 5:
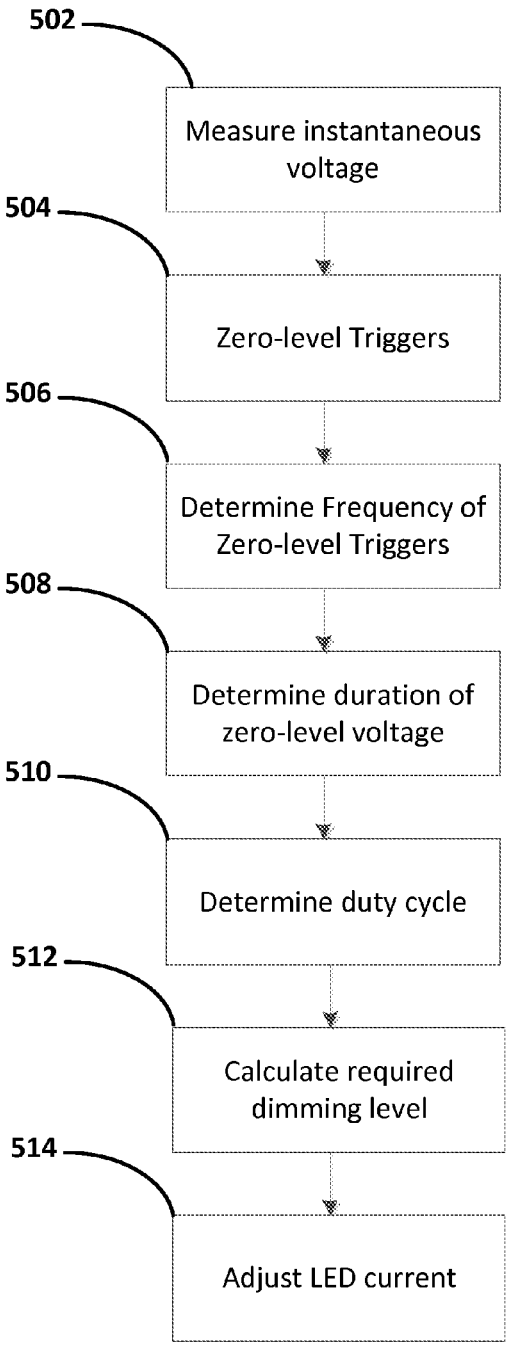
FIG. 5 illustrates a flowchart of an exemplary embodiment of a method for determining a proper current level to be applied to a LED load by a dimming controller incorporating aspects of the present disclosure.

FIG. 5 illustrates an exemplary embodiment of a method for determining a proper current level to be applied to a LED load 312 by a dimming controller such as the dimming controller 309 illustrated in FIG. 3. The exemplary method relies on information from the filtered power signal 320 and the zero-level detection triggers 404 illustrated in FIG. 4 above. The method begins by taking a series of instantaneous voltage measurements 502 from the filtered power signal 320. In certain embodiments these measurements may be made by digitizing the filtered power signal 320. For example, when the input power signal is an analog input power signal, sampling the voltage of the input power signal includes using an analog to digital converter to convert the voltage of the filtered power signal 320 a digital input power signal that is made up of a series of digital values. The digital values are provided to a processing device. The series of zero-level detection triggers 404 is received or detected 504 and the frequency of the zero-level detection triggers 404 is determined 506. Once the frequency of the zero-level detection triggers 404 is known, the period of the zero-level detection triggers 404, i.e. the amount of time between each zero-level detection trigger 404, may be computed. Next, the series of instantaneous voltage measurements 502 are processed to determine the zero level duration 508, which is the amount of time the filtered power signal 320 remains at or close to zero volts during one period of the zero-level detection triggers 404. The duty cycle of the filtered power signal 320 can then be determined 510 as:

$$\text{Duty Cycle} = 1 - \left(\frac{\text{zero level duration}}{\text{trigger period}}\right).$$

Once the duty cycle has been determined a dimming level can be calculated 512. Light produced by an incandescent lamp is directly related to, but is not linearly proportional to the amount of power applied to the lamp. Further, the power contained in a phase control power signal, such as the phase control dimming signals illustrated in FIGS. 2 and 3, is directly related to, but is not linearly proportional to, a duty cycle of the power signal. Because of this non-linear relationship, calculation of the required dimming level 512 from the duty cycle can be quite complex. Thus, in certain embodiments linear approximations are used for this calculation 512. Alternatively, a lookup table which associates predetermined current values or required dimming levels to values of the duty cycle may be used to simplify run-time computation of the required dimming level 512. Finally, the power supply unit 308 must be operated to adjust the current 514 delivered to an LED load 312 such that the light produced by the LED load 312 is at the required dimming level.

In certain embodiments, the processes illustrated in FIG. 5 are in the form of instructions stored in memory of a microcontroller, or other computing device and are executed by a processor of the microcontroller or other computing device. In alternate embodiments, the processes of FIGS. 3 and 4 may be performed by analog and digital circuits or some combination of analog and digital circuits, and microcontroller instructions.

The aspects of the disclosed embodiments provide for retrofitting traffic control signals that contain incandescent signal lamps with dimmable energy saving LED signal lamps. In one embodiment, a dimmable LED lamp assembly is provided. The dimmable LED lamp assembly, such as the LED lamp unit assembly 306 shown in FIG. 3, is configured to determine a required brightness based on an input power signal and adjust a brightness of the LED lamp assembly in accordance with the determined required brightness. The dimmable LED lamp assembly is packaged such that it is physically and electrically compatible with the incandescent signal lamps. This configuration and packaging allows for replacement of an incandescent signal lamp with the packaged dimmable LED lamp assembly.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A dimmable LED lamp assembly, the lamp assembly comprising:

a power supply configured to receive an AC input power signal and produce a DC lamp current;

a LED lamp coupled to the DC lamp current and configured to produce an amount of light corresponding to an amount of the DC lamp current; and a dimming controller coupled to the power supply and configured to adjust the amount of the DC lamp current, wherein the dimming controller receives the AC input power signal as an input and is further configured to determine a required dimming level based on the power of the AC input power signal and to adjust the amount of DC lamp current such that the amount of light produced by the LED lamp corresponds to the determined required dimming level.

2. The lamp assembly according to claim 1, wherein the dimming controller is configured to determine the required dimming level by calculating a duty cycle of the AC input power signal, wherein the required dimming level corresponds to the calculated duty cycle.

3. The lamp assembly according to claim 2, wherein the dimming controller is configured to calculate the duty cycle of the AC input power signal by:

determining a period of the AC input power signal;

measuring a zero-level duration of the AC input power signal; and calculating a percentage of the period where the AC input power signal is not at the zero-level, wherein the zero-level duration comprises an amount of time a voltage of the AC input power signal remains at substantially zero volts during one period of the AC input power signal.

4. The lamp assembly according to claim 3, wherein the dimming controller is configured to measure the zero level duration by determining an amount of time a voltage of the AC input power signal remains within a predetermined threshold amount of zero volts.

5. The lamp assembly according to claim 4, wherein the dimming controller is configured to determine the period of the AC input power signal by:

detecting a series of zero-level detection triggers from the AC input power signal; and measuring an amount of time between successive zero-level detection triggers.

6. The lamp assembly according to claim 5, wherein the dimming controller comprises:

an analog to digital converter;

a processor; and a memory, wherein the analog to digital converter is coupled to the AC input power signal and is configured to produce a digitized input power signal, and wherein the processor is configured to:

receive the digitized input power signal;

generate the series of zero-level detection triggers;

determine the period of the analog input power signal by measuring the amount of time between successive zero-level detection triggers;

measure the zero level duration of the digitized input power signal;

calculate the duty cycle from the determined period of the AC input power signal and the measured zero-level duration; and adjust the amount of DC lamp current based on the calculated duty cycle.

7. The lamp assembly according to claim 6, wherein the processor is configured to adjust the amount of DC lamp current using a lookup table to select a predetermined amount of DC lamp current corresponding to the calculated duty cycle.

8. The lamp assembly according to claim 6, wherein the AC input power signal comprises a phase control dimming signal.

9. The lamp assembly according to claim 6, comprising an inrush limiter coupled between an external power signal and the AC input power signal, wherein the inrush limiter is configured to prevent an inrush current from exceeding a predetermined amount.

10. The lamp assembly according to claim 9, wherein the inrush limiter is further configured to filter and clean the external power signal.

11. The lamp assembly according to claim 6, wherein the LED lamp comprises a plurality of LED elements.

12. The lamp assembly according to claim 6, wherein the lamp assembly is configured to be physically and electrically compatible with existing incandescent signal lamps.

13. The lamp assembly according to claim 1, wherein the dimming controller is configured to determine the required dimming level by calculating a duty cycle of the AC input power signal, wherein the required dimming level corresponds to the calculated duty cycle; and wherein the AC input power signal comprises a phase control dimming signal.

14. A method for controlling the brightness of an LED lamp, the method comprising:

sampling the voltage of an AC power signal received as an input to create a digital input power signal;

measuring a zero-level duration of the digital input power signal;

generating a series of zero-level detection triggers from the digital input power signal;

determining a period of the zero-level detection triggers;

calculating a duty cycle of the digital input power signal based on the measured zero-level duration and the determined period of the zero-level detection triggers;

determining the power of the AC input power signal from the duty cycle; and adjusting an amount of DC current delivered to the LED lamp such that a brightness of the LED lamp corresponds to the determined power of the AC input power signal.

15. The method according to claim 14, wherein sampling the voltage of the AC input power signal comprises:

receiving the AC input power signal; and converting the AC input power signal to a digital input power signal using an analog-to-digital converter and sampling an analog-to-digital converter output to create a digital input power signal.

16. The method according to claim 14 wherein the AC input power signal comprises a phase control dimming signal.

17. A method of retrofitting a traffic control signal that contain at least one incandescent signal lamp with dimmable LED signal lamps, the method comprising:

providing a dimmable LED lamp assembly; including:

a power supply configured to receive an AC input power signal and produce a DC lamp current;

a LED lamp coupled to the DC lamp current and configured to produce an amount of light corresponding to an amount of the DC lamp current; and a dimming controller coupled to the power supply and configured to adjust the amount of the DC lamp current, wherein the dimming controller receives the AC input power signal as an input and is further configured to determine a required dimming level based on the power of the AC input power signal and to adjust the amount of DC lamp current such that the amount of light produced by the LED lamp corresponds to the determined required dimming level;

packaging the dimmable LED lamp assembly such that it is physically and electrically compatible with the incandescent signal lamps; and replacing the incandescent signal lamp with the packaged dimmable LED lamp assembly.

* * * * *